US008575464B1

(12) United States Patent
Butterworth, III

(10) Patent No.: US 8,575,464 B1
(45) Date of Patent: Nov. 5, 2013

(54) CURVED TREMOLO ARM

(76) Inventor: Charles E. Butterworth, III, Birmingham, AL (US)

( * ) Notice: Subject to any disclaimer, the term of this patent is extended or adjusted under 35 U.S.C. 154(b) by 26 days.

(21) Appl. No.: 13/418,085

(22) Filed: Mar. 12, 2012

(51) Int. Cl.
*G10D 3/00* (2006.01)

(52) U.S. Cl.
USPC ..... 84/313

(58) Field of Classification Search
None
See application file for complete search history.

(56) References Cited

U.S. PATENT DOCUMENTS

| | | | | |
|---|---|---|---|---|
| D198,714 | S | 7/1964 | Burns | |
| 3,411,394 | A | 11/1968 | Jones | |
| 4,171,661 | A | 10/1979 | Rose | |
| D278,067 | S | 3/1985 | Bowen | |
| 4,512,232 | A | 4/1985 | Schaller | |
| 4,608,906 | A | 9/1986 | Takabayashi | |
| 4,656,915 | A | 4/1987 | Osuga | |
| 4,681,011 | A | 7/1987 | Hoshino | |
| 4,852,448 | A | 8/1989 | Hennessey | |
| 5,046,393 | A | 9/1991 | Xenidis | |
| 5,400,684 | A | 3/1995 | Duffy | |
| D371,385 | S | 7/1996 | Rudolph | |
| 5,942,703 | A | 8/1999 | Boehnlein et al. | |
| 6,875,911 | B2 * | 4/2005 | Schryer | 84/313 |
| 7,247,780 | B2 | 7/2007 | Sanders et al. | |
| D608,386 | S | 1/2010 | Wright | |
| 7,838,751 | B2 | 11/2010 | Hendricks | |
| 8,017,844 | B2 | 9/2011 | Steinberger | |
| 2011/0154972 | A1 | 6/2011 | Bisheimer | |

OTHER PUBLICATIONS http://www.tonefactory.nl/shop2/style-tremolo-handle-black-p-2304.html 2 pages from website dated Nov. 10, 2011 and directed to a F-style Tremolo handle.

* cited by examiner

*Primary Examiner* — Kimberly Lockett
(74) *Attorney, Agent, or Firm* — Kenneth M. Bush; Gerald M. Walsh; Bush Intellectual Property Law

(57) ABSTRACT

A tremolo bar formed as a single curved rod having a handle portion with a first curved U-shaped loop, a second U-shaped loop, and a root portion for attachment of the root portion to a bridge system of a guitar. The U-shaped loops provide a secure means for a user to hold and operate the handle portion with one or more fingers continuously while playing the strings of the guitar without interference from the holding and operating of the handle. A user can insert or hook a finger into the loops to hold and operate the handle. The looped handle eliminates the need for the user to grasp and release the handle repeatedly during the course of picking and strumming the strings while performing.

16 Claims, 3 Drawing Sheets

CURVED TREMOLO ARM

FIELD OF THE INVENTION

This invention relates generally to stringed musical instruments and, more particularly to a curved tremolo arm which can be held continuously while playing the strings of a guitar without interfering with the playing of the strings.

BACKGROUND OF THE INVENTION

A tremolo arm 33, as shown in FIGS. 1 and 2, is used with a tremolo/bridge assembly 31 of a guitar 30, as is known in the art, to change the pitch of the strings 32 as desired while playing the guitar 30. The tremolo system allows the bridge assembly to rotate towards or away from the face 36 of the guitar 30. The tremolo arm 33 provides the user a lever to easily cause this rotation in the bridge assembly. The tremolo arm 33 may have a root portion 34 with threads 36 and a handle portion 35. The angle "theta" between the root portion 34 and the handle portion 35 is usually a right angle but can also be an obtuse angle. When the handle portion 35 is pushed towards the face 36 of guitar 30 the pitch of the strings 32 is lowered. When the handle portion 35 is returned to its resting position the pitch of the strings is returned to normal. When the handle portion 35 is pulled away from the face 36 the pitch of the strings 32 is raised.

Standard tremolo arms are generally relatively straight and the user is required to hold the straight tremolo arm with one or two fingers. However, when the user is playing the strings while trying to grasp and/or hold the tremolo arm, the playing of the strings can be interrupted and/or the tremolo arm can unintentionally slip away from the fingers of the user. What is needed, but heretofore has not been available, is a tremolo arm which can be held continuously and securely with one or two fingers while playing the strings of the guitar with the rest of the fingers, and which will not interfere with the playing of the strings.

SUMMARY OF THE INVENTION

The invention is a tremolo bar formed as a single curved rod having a handle portion with a first curved U-shaped loop, a second U-shaped loop, and a root portion for attachment of the root portion to a bridge system of a guitar, wherein the U-shaped loops provide a secure means for a user to hold and operate the handle portion with one or more fingers continuously while playing the strings of the guitar without interference from the holding and operating of the handle. A user can insert or hook a finger into the loops to hold and operate the handle. The curved and looped handle eliminates the need for the user to grasp and release the handle repeatedly during the course of picking and strumming the strings while performing. The handle has a first leg extending from a root portion and extending to form a second leg, thereby forming a first U-shaped loop having a base and an open end. The second leg extends from the first leg to form a third leg, thereby forming a second U-shaped loop having a base and an open end. The third leg extends from the second leg towards the first base of the first U-shaped loop, thereby forming an enclosure arm enclosing, or partially enclosing the open end of the second U-shaped loop. The U-shaped loops and the enclosure arm form the handle portion and are all in the same plane and, thus, are perpendicular, or approximately perpendicular (70 degrees to 110 degrees), to the plane of the root portion.

An advantage of the invention is a tremolo handle which can be held continuously with one or two fingers while playing the guitar without interfering with the strumming and/or picking of the guitar strings.

Another advantage is a tremolo handle that is easy to hold and operate with one or two fingers.

Another advantage is a tremolo handle that is easy to attach and remove from the guitar.

Another advantage is a tremolo handle that is simple and inexpensive to construct.

DETAILED DESCRIPTION OF THE INVENTION

While the following description details the preferred embodiments of the present invention, it is to be understood that the invention is not limited in its application to the details of construction and arrangement of the parts illustrated in the accompanying drawings, since the invention is capable of other embodiments and of being practiced in various ways.

Figure 1:
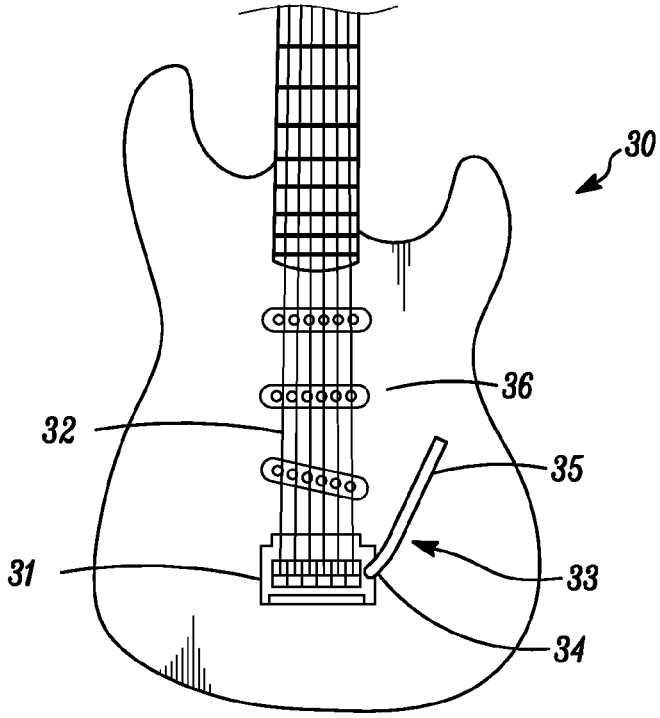
(PRIOR ART) FIG. 1
FIG. 1 shows a guitar with a tremolo bar known in the art.
Figure 2:
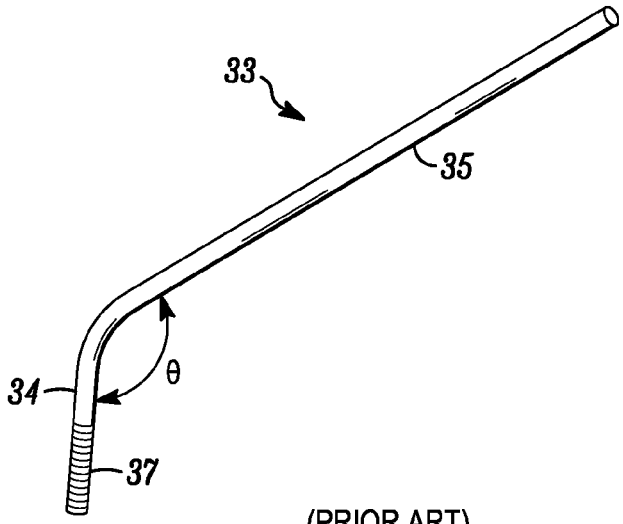
(PRIOR ART) FIG. 2
FIG. 2 shows a standard tremolo bar known in the art.
Figure 3:
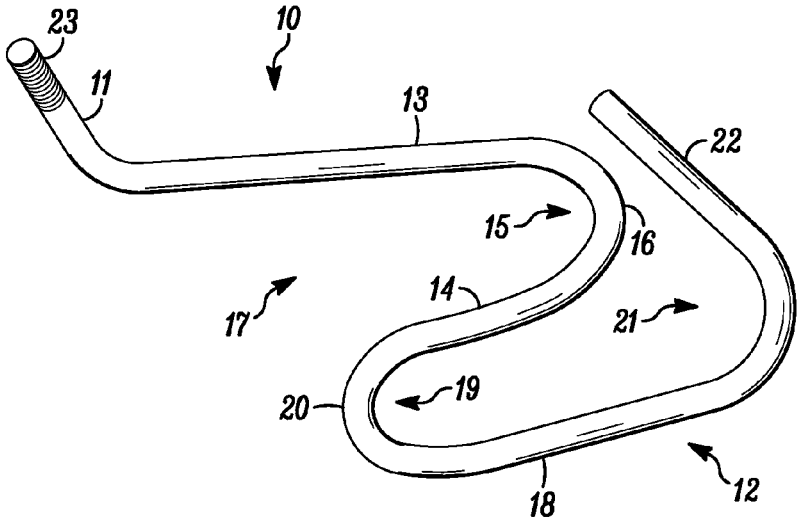
FIG. 3 shows the curved tremolo bar of the invention.

FIG. 3 shows the tremolo arm 10 of the present invention which is a curved rod. The tremolo arm 10 has a root portion 11 and a handle portion 12 wherein the handle portion 12 is perpendicular, or approximately perpendicular (a 70 degree to a 110 degree angle), to the plane of the root portion 11. A first leg 13 extends from the root portion 11 to form a second leg 14, thereby forming a first U-shaped loop 15 having a base 16 and an open end 17. The second leg 14 extends from the first leg 13 to form a third leg 18, thereby forming a second U-shaped loop 19 having a base 20 and an open end 21. The third leg 18 extends towards the first base 16 of the first U-shaped loop 15, thereby forming an enclosure arm 22 which encloses, or partially encloses, open end 21 of second the U-shaped loop 19. The U-shaped loops 15 and 19 and the enclosure arm 22 of the handle portion 12 are all in the same plane and, thus, are perpendicular, or approximately perpendicular (a 70 degree to a 110 degree angle), to the plane of the root portion 11. The root portion 11 may have threads 23 to reversibly attach the root portion 11 to a tremolo/bridge assembly of a guitar.

Figure 4:
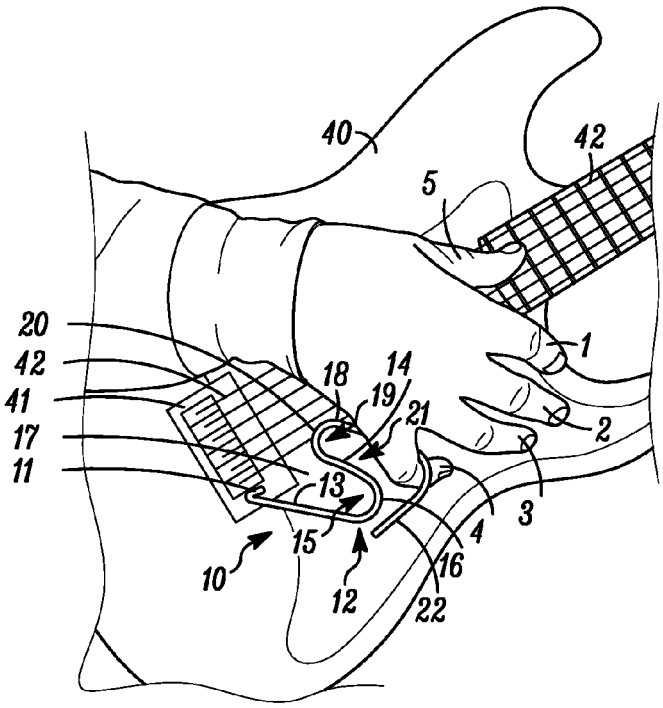
FIG. 4 illustrates a user operating the tremolo bar with one finger.

FIG. 4 illustrates a user using the tremolo arm 10 with the little finger 4 while the other fingers 1, 2, and 3 and thumb 4 are free to play the strings 42 of guitar 40. The little finger 4 is shown hooked into the second U-shaped loop 19, adjacent to the enclosure arm 22. The user can hold and operate the tremolo arm 10 with the little finger 4 without compromising the ability of the other fingers 1, 2, 3, and 5 to play the strings 42. The tremolo arm 10 is shown attached to the tremolo/bridge assembly 41 of guitar 40 by means of root portion 11.

Figure 5:
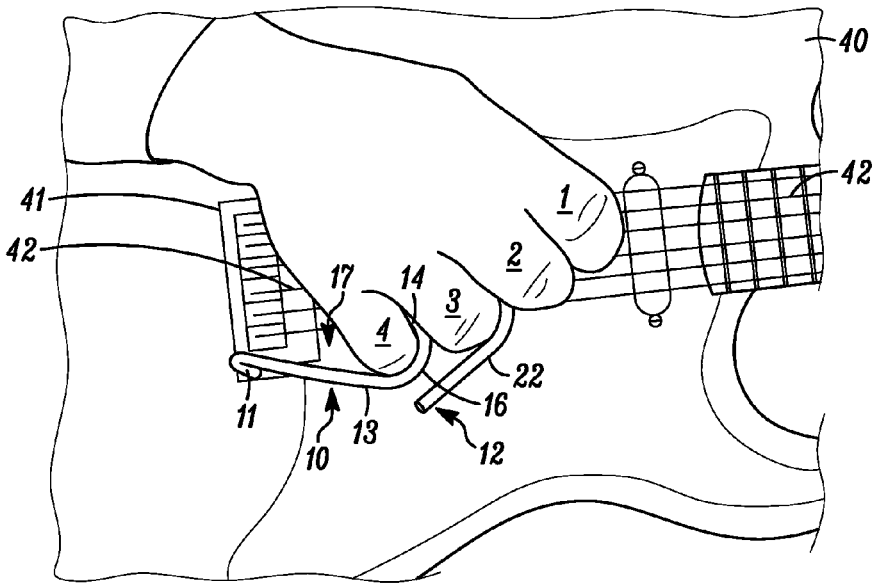
FIG. 5 illustrates a user operating the tremolo bar with two fingers.

FIG. 5 illustrates a user using the tremolo arm 10 with the third 3 and the fourth 4 fingers while the other fingers 1 and 2 and the thumb 5 are free to play the strings 42 of guitar 40. Finger 3 is positioned within the second U-shaped loop 19 and finger 4 is positioned within the first U-shaped loop 15.

The user can hold and operate the tremolo arm 10 with the fingers 3 and 4 without compromising the ability of the other fingers 1, 2, and 5 to play the strings 42.

Figure 6:
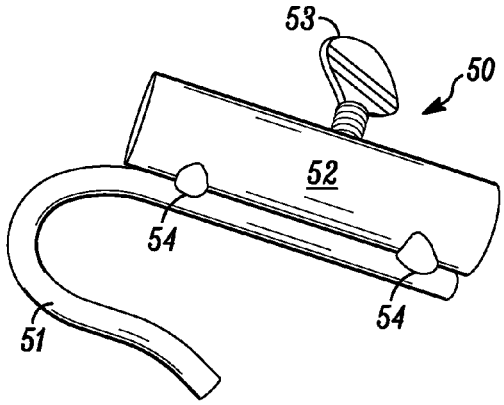
FIG. 6 shows an alternate embodiment of a curved tremolo handle adapter that can be attached to a standard tremolo bar.

FIG. 6 shows an alternate embodiment of the invention which is a tremolo bar handle adapter 50 having a sleeve 52 with a U-shaped loop 51 attached thereto. The U-shaped loop 51 can be attached to the sleeve 52 at desired locations 54 by methods known in the art such as gluing, welding, soldering, and the like. The sleeve 52 has a thumb screw or set screw 53 to reversibly fasten the sleeve 52 to a standard tremolo bar handle 35.

Figure 7:
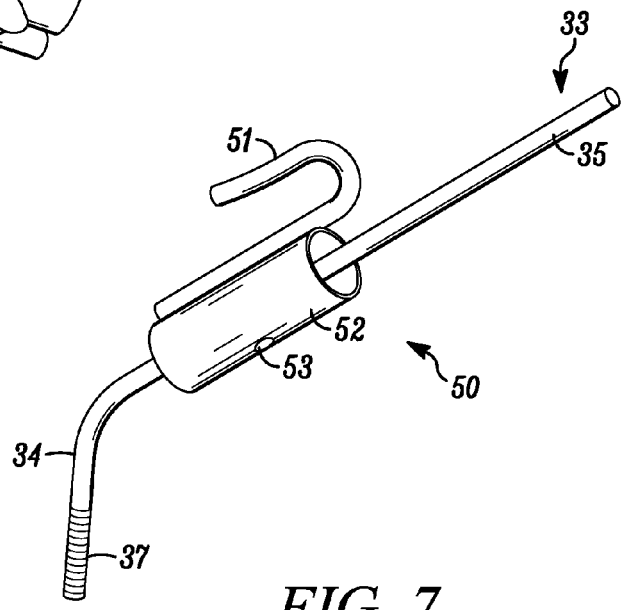
FIG. 7 illustrates the curved handle adapter attached to a standard tremolo bar.

FIG. 7 illustrates the tremolo handle adapter 50 positioned on a tremolo handle 35 by passing the tremolo handle 35 through the sleeve 52 and tightening the thumb screw or set screw 53. A user can insert one or more fingers into the U-shape loop 51 to hold and operate the tremolo bar 33.

The embodiments of the invention can be used to form a kit for replacing or modifying the tremolo bar of a guitar in which the kit contains the tremolo handle 10 and the tremolo handle adapter 50. The kit can further contain one or more screws 53 for the sleeve 52 and can contain a standard tremolo bar such as, for example, the tremolo bar 33 shown in FIG. 7 which can be reversibly attached to a bridge apparatus, and which has an approximately straight tremolo bar handle 35.

The embodiments of the present invention can be constructed with any suitable material such as plastics, metals, wood or combinations thereof. They may also be constructed in any suitable dimensions and used with any type of guitar or other stringed instrument.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A tremolo bar, comprising a rod having a handle portion with a first U-shaped loop and a second U-shaped loop and having a root portion for attachment of said root portion to a bridge system of a guitar, wherein both of said U-shaped loops provide a secure means for a user to hold and operate said handle portion with one or more fingers continuously while playing the strings of the guitar, said second U-shaped loop having an enclosure arm which encloses, or partially encloses, an open end of said first U-shaped loop to further secure a finger of a user within said first U-shaped loop.

2. The tremolo bar of claim 1, further comprising said root portion being reversibly attachable to the bridge system of the guitar.

3. A tremolo bar, comprising:

a) a rod having a root portion and a handle portion wherein said handle portion is in a plane approximately perpendicular to the plane of said root portion;

b) said handle portion having a first leg extending from said root portion and extending to form a second leg, thereby forming a first U-shaped loop having a base and an open end;

c) said second leg extending from said first leg to form a third leg, thereby forming a second U-shaped loop having a base and an open end; and d) said third leg extending from said second leg towards said base of said first U-shaped loop, thereby forming an enclosure over said opening of said second U-shaped loop.

4. The tremolo bar of claim 3 wherein said first U-shaped loop, said second U-shaped loop, and said enclosure are all in the same plane, and wherein said first U-shaped loop and said second U-shaped loop allow the insertion therein of the fingers of a user to operate said handle portion.

5. The tremolo bar of claim 4 further comprising said root portion being reversibly attachable to the bridge system of a guitar.

6. The tremolo bar of claim 5 wherein both of said U-shaped loops provide a secure means for a user to hold and operate said handle portion with one or more fingers continuously while playing the strings of the guitar.

7. A tremolo bar handle adapter, comprising a sleeve with a U-shaped loop attached thereto, said sleeve having a screw to reversibly fasten said sleeve to a tremolo bar handle, wherein said U-shaped loop provides a secure means for a user to hold and operate said tremolo bar handle continuously while playing the strings of a guitar.

8. A kit for replacing or modifying a tremolo bar of a guitar, comprising:

a) a tremolo bar comprising a rod having a handle portion with a first U-shaped loop and a second U-shaped loop and having a root portion for attachment of said root portion to a bridge system of a guitar, wherein both of said U-shaped loops provide a secure means for a user to hold and operate said handle portion with one or more fingers continuously while playing the strings of the guitar; and b) a tremolo bar handle adapter comprising a sleeve with a U-shaped loop attached thereto, said sleeve having a screw to reversibly fasten said sleeve to a tremolo bar handle, wherein said U-shaped loop provides a secure means for a user to hold and operate said tremolo bar handle continuously while playing the strings of a guitar.

9. The kit of claim 8 further comprising said second U-shaped loop having an enclosure arm which encloses, or partially encloses, an open end of said first U-shaped loop to further secure a finger of a user within said first U-shaped loop.

10. The kit of claim 9 further comprising said root portion being reversibly attachable to the bridge system of the guitar.

11. The kit of claim 8 further comprising a tremolo bar with an approximately straight handle for reversible attachment to a guitar for further attachment of said tremolo bar handle adapter.

12. A kit for replacing or modifying a tremolo bar of a guitar, comprising:

1) a tremolo bar, comprising:

a) a rod having a root portion and a handle portion wherein said handle portion is in a plane approximately perpendicular to the plane of said root portion;

b) said handle portion having a first leg extending from said root portion and extending to form a second leg, thereby forming a first U-shaped loop having a base and an open end;

c) said second leg extending from said first leg to form a third leg, thereby forming a second U-shaped loop having a base and an open end; and d) said third leg extending from said second leg towards said base of said first U-shaped loop, thereby forming an enclosure over said opening of said second U-shaped loop; and 2) a tremolo bar handle adapter comprising a sleeve with a U-shaped loop attached thereto, said sleeve having a screw to reversibly fasten said sleeve to a tremolo bar handle, wherein said U-shaped loop provides a secure means for a user to hold and operate said tremolo bar handle continuously while playing the strings of a guitar.

13. The kit of claim 12 wherein said first U-shaped loop, said second U-shaped loop, and said enclosure are all in the same plane, and wherein said first U-shaped loop and said second U-shaped loop allow the insertion therein of the fingers of a user to operate said handle portion.

14. The kit of claim 13 further comprising said root portion being reversibly attachable to the bridge system of a guitar.

15. The kit of claim 12 wherein both of said U-shaped loops provide a secure means for a user to hold and operate said handle portion with one or more fingers continuously while playing the strings of the guitar.

16. The kit of claim 12 further comprising a tremolo bar with an approximately straight handle for reversible attachment to a guitar for further attachment of said tremolo bar handle adapter.

* * * * *